US011781745B2

(12) United States Patent
Ura et al.

(10) Patent No.: US 11,781,745 B2
(45) Date of Patent: Oct. 10, 2023

(54) SPEAKER

(71) Applicant: Balmuda Inc., Tokyo (JP)

(72) Inventors: Junya Ura, Musashino (JP); Jun Takano, Musashino (JP); Tamafumi Sasada, Musashino (JP); Shu Kokubo, Musashino (JP)

(73) Assignee: Balmuda Inc., Tokyo (JP)

( * ) Notice: Subject to any disclaimer, the term of this patent is extended or adjusted under 35 U.S.C. 154(b) by 0 days.

(21) Appl. No.: 17/909,686

(22) PCT Filed: Apr. 3, 2020

(86) PCT No.: PCT/JP2020/015414
§ 371 (c)(1),
(2) Date: Sep. 6, 2022

(87) PCT Pub. No.: WO2021/199448
PCT Pub. Date: Oct. 7, 2021

(65) Prior Publication Data
US 2023/0105454 A1 Apr. 6, 2023

(51) Int. Cl.
*F21V 33/00* (2006.01)
*H05B 45/30* (2020.01)
(Continued)

(52) U.S. Cl.
CPC ..... *F21V 33/0056* (2013.01); *H04R 1/025* (2013.01); *H04R 1/028* (2013.01); *H05B 45/30* (2020.01); *F21Y 2115/10* (2016.08)

(58) Field of Classification Search
CPC ..... F21V 33/0056; F21V 33/0052; F21V 33/0004; F21V 33/00; F21V 7/00;
(Continued)

(56) References Cited

U.S. PATENT DOCUMENTS 5,886,304 A 3/1999 Schlenzig et al.
7,535,341 B2 * 5/2009 Haase ..... H04R 1/028 340/693.11
(Continued)

FOREIGN PATENT DOCUMENTS

CN 109404821 A 3/2019
JP 05-145983 A 6/1993
(Continued)

OTHER PUBLICATIONS

Office Action issued in JP 2022-511496, dated Apr. 25, 2023 and translation (7 pages).
(Continued)

*Primary Examiner* — Bao Q Truong
(74) *Attorney, Agent, or Firm* — Ice Miller LLP

(57) ABSTRACT

A speaker outputting sound from a speaker portion arranged facing upward. The speaker is provided with: a first head portion including the speaker portion; a first base portion; a transparent first housing arranged between the first head portion and the first base portion; at least one LED unit arranged inside the first housing; and a control portion for driving LED elements of the LED unit on the basis of a sound signal from the outside. Each LED unit is provided with: a second head portion; a second base portion; and a transparent second housing arranged between the second head portion and the second base portion. As a result, light linked to the sound, emitted from the LED elements of the LED units, can be efficiently delivered to the eye of the user.

18 Claims, 15 Drawing Sheets

(51) Int. Cl.
*H04R 1/02* (2006.01)
*F21Y 115/10* (2016.01)

(58) Field of Classification Search
CPC ..... H05B 45/30; H05B 45/20; H04R 1/025; H04R 1/028; H04R 1/00; H04R 2201/028; F21Y 2115/10
See application file for complete search history.

(56) References Cited

U.S. PATENT DOCUMENTS

| | | | | |
|---|---|---|---|---|
| 8,847,491 | B2 * | 9/2014 | Yotsumoto ..... | H05B 47/175 362/547 |
| 2008/0225510 | A1 | 9/2008 | Rocha | |
| 2013/0028458 | A1 | 1/2013 | Nobukazu | |
| 2015/0049461 | A1 * | 2/2015 | Yotsumoto ..... | F21V 23/02 362/86 |

FOREIGN PATENT DOCUMENTS

| | | | |
|---|---|---|---|
| JP | 2008-109237 | A | 5/2008 |
| JP | 2011-223312 | A | 11/2011 |
| JP | 2018-042065 | A | 3/2018 |
| JP | 2019-080254 | A | 5/2019 |

OTHER PUBLICATIONS

International Preliminary Report on Patentability for International Patent Application No. PCT/JP2020/015414, with English translation, dated Oct. 13, 2022 (12 pages).
International Search Report for Application No. PCT/JP2020/015414, dated Jun. 30, 2020, with English translation (5 pages).
Written Opinion of International Searching Authority for Application No. PCT/JP2020/015414, dated Jun. 30, 2020; Wnglish translation unavailable (4 pages).
Shaba Audio; "Wireless Speaker" product description webpage; retrieved from https://www.shaba-audio-com/page368?_1=EN on Sep. 7, 2022 (2 pages).

* cited by examiner

SPEAKER

CROSS-REFERENCE TO RELATED APPLICATIONS

This application is a U.S. National Stage of International Application No. PCT/JP2020/015414, filed Apr. 3, 2020, the contents of which are incorporated herein by reference in its entirety.

TECHNICAL FIELD

The present invention relates to a speaker, and more particularly relates to a speaker in which a transmissive member is used to make a speaker housing transparent so that its internal space can be used for a presentation of light or the like.

BACKGROUND

There is a conventionally known speaker in which a speaker unit (also referred to as a speaker portion) is installed upward and light-emitting elements interlocking with sound are provided. Such a device enables users to enjoy both sound and light. Patent Document 1 discloses a speaker with a light emitting function that includes a speaker unit installed upward and LED elements provided on the outer peripheral edge of a top board arranged on the upper side of the speaker unit.

CITATION LIST

Patent Literature

Patent Document 1: JP2019-80254 A

Non Patent Literature

Non-patent Document 1: http://www.shaba-audio.com/page368?_l=EN

SUMMARY

Technical Problem

In such a speaker including light-emitting elements interlocking with sound, there have been cases where an object having light-emitting elements is placed in an internal space of the speaker. However, there is a problem that the object itself becomes a shield that shields the light of the light-emitting elements.

The present invention intends to provide a speaker in which an object having light-emitting elements interlocking with sound is arranged in its internal space and can suppress shielding, by the object, of light emitted from the light-emitting elements.

Solution to Problem

A speaker of the present invention is a speaker that outputs sound from a speaker portion arranged upward and includes a first head portion including the speaker portion, a first base portion, a first housing having transmissivity and arranged between the first head portion and the first base portion, at least one LED unit arranged in the first housing, and a control unit configured to drive LED elements of the LED unit based on a sound signal from the outside. The LED unit includes a second head portion, a second base portion, and a second housing having transmissivity and arranged between the second head portion and the second base portion.

In the speaker of the present invention, the first head portion may be arranged on the upper side of the first base portion with an interval therebetween, and an upper-side surface of the first base portion includes a mirror surface.

The speaker of the present invention may further include first connection means having a reflective outer surface, and the first head portion and the first base portion may be connected by the first connection means.

In the speaker of the present invention, the LED unit may further include second connection means having a reflective outer surface, and the second head portion and the second base portion may be connected by the second connection means.

In the speaker of the present invention, a first LED element serving as one of the LED elements may be attached to the second base portion, and a second LED element serving as another one of the LED elements may be attached to the second head portion.

In the speaker of the present invention, the second head portion may be arranged on the upper side of the second base portion with an interval therebetween, and the first LED element may be attached to the second base portion so as to have an optical axis directed upward, and the second LED element may be attached to the second head portion so as to have an optical axis directed downward.

In the speaker of the present invention, the control unit may supply, to the first LED element, a first driving signal based on a signal whose main component is a first frequency domain of the sound signal, and supply, to the second LED element, a second driving signal based on a signal whose main component is a second frequency domain of the sound signal, in which the second frequency domain is higher than the first frequency domain.

In the speaker of the present invention, the control unit may switch the driving signal supplied to the first LED element from the first driving signal to the second driving signal, according to a user operation.

In the speaker of the present invention, a third LED element may be attached to an upper-side outer peripheral portion of the first base portion, so as to have an optical axis directed upward, and the control unit supplies, to the third LED element, a third driving signal based on a signal whose main component is a third frequency domain of the sound signal, in which the third frequency domain is lower than the first frequency domain.

In the speaker of the present invention, the control unit may correct the third driving signal based on the transition of the sound signal and the current sound signal.

The speaker of the present invention may further include signal generation means, wherein, when no sound signal is supplied from the outside, the control unit may drive the LED element based on a signal generated by the signal generation means, instead of based on the sound signal.

In the speaker of the present invention, when the speaker is viewed from the front, a center LED unit may be arranged in the center and a left-side LED unit and a right-side LED unit may be arranged on the left and right sides of the center LED unit, as multiple LED units, and the control unit may supply a driving signal based on a left signal component of the sound signal to an LED element of the left-side LED unit, a driving signal based on a right signal component of the sound signal to an LED element of the right-side LED unit, and a driving signal based on a mixed signal component of the left signal component and the right signal component to an LED element of the center LED unit.

In the speaker of the present invention, the first head portion may include a frame, to which an upper end of the first connection means is attached, and a cushion member, wherein multiple bosses may be provided on an upper surface of the frame with intervals therebetween, the cushion member may be arranged on the upper surface of the frame, while avoiding each of the bosses, a fixing part provided on an outer periphery of the speaker portion may be arranged on each boss of the frame and fixed, and a space formed by each boss between a lower surface of the fixing part of the speaker portion and the upper surface of the frame may be closed by the cushion member.

In the speaker of the present invention, the LED element of the LED unit may have a ½ beam angle that is equal to or greater than 120 degrees.

Advantageous Effects of Invention

According to the present invention, the LED unit (object) including the second housing having transmissivity is arranged in the internal space of the first housing having transmissivity. Therefore, the light emitted from the LED element of the LED unit, which is interlocked with the sound, can be efficiently delivered to the user's eyes, without being shielded by the LED unit and the first housing, or while suppressing the shielding by them.

DESCRIPTION OF EMBODIMENTS

Figure 1:
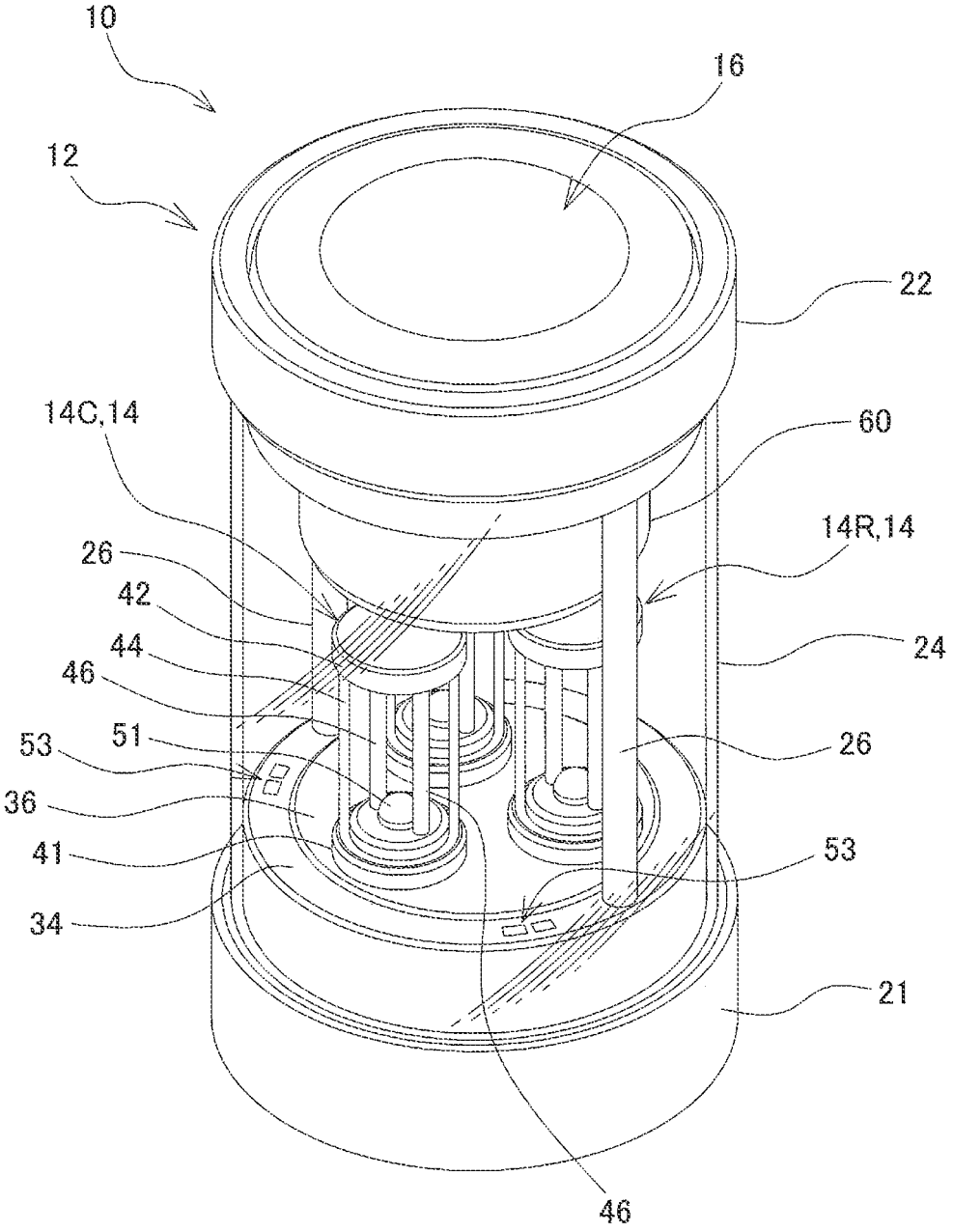
FIG. 1 is a front side perspective view of a speaker.

Hereinafter, an embodiment according to the present invention will be described in detail with reference to attached drawings. The configuration described below is an example for explanation, and can be appropriately modified according to specifications and the like of each member configuring the speaker. The same elements are denoted by the same reference numerals in all drawings, and duplicate description is omitted.

Figure 2:
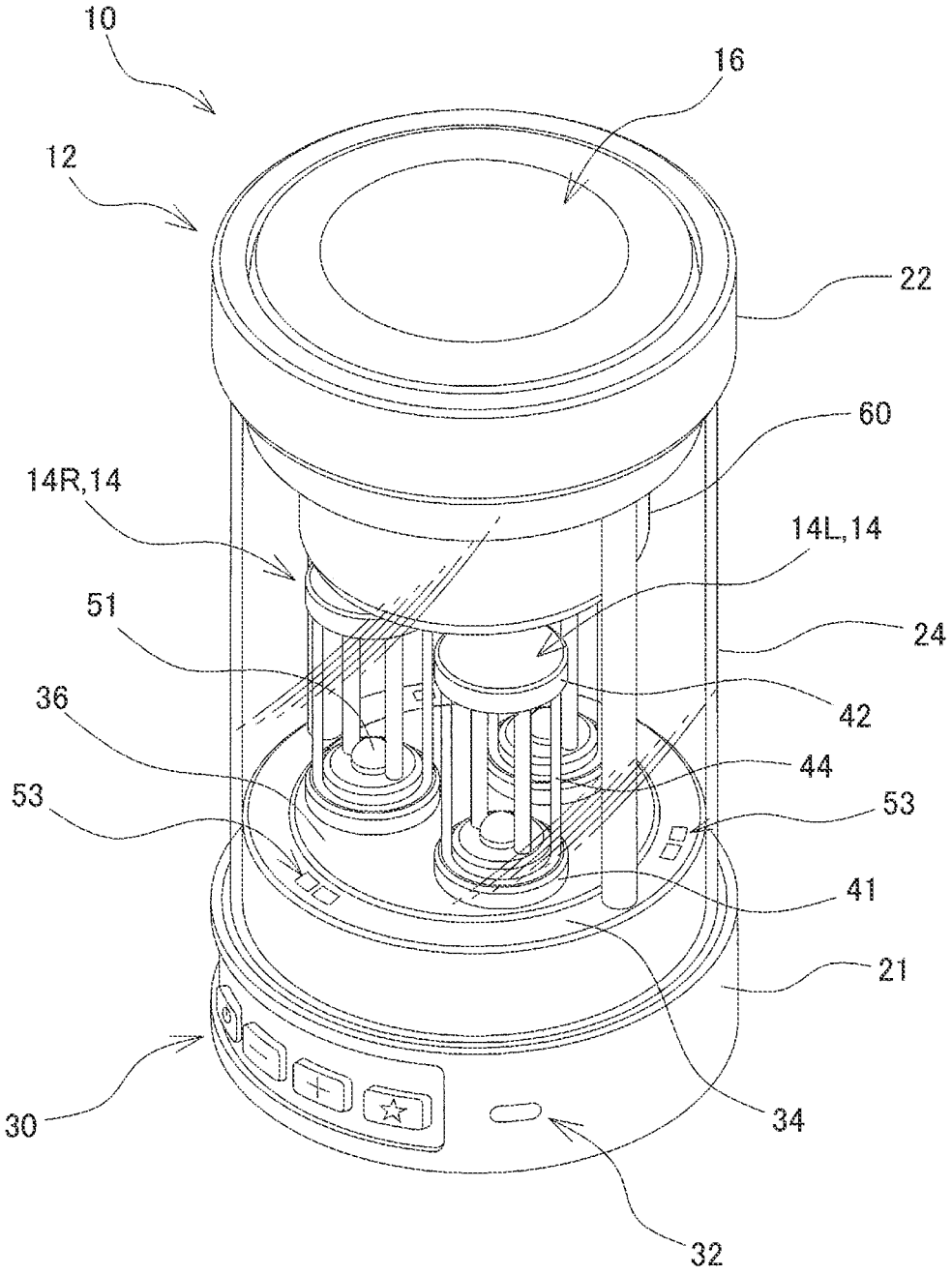
FIG. 2 is a back side perspective view of the speaker.
Figure 3:
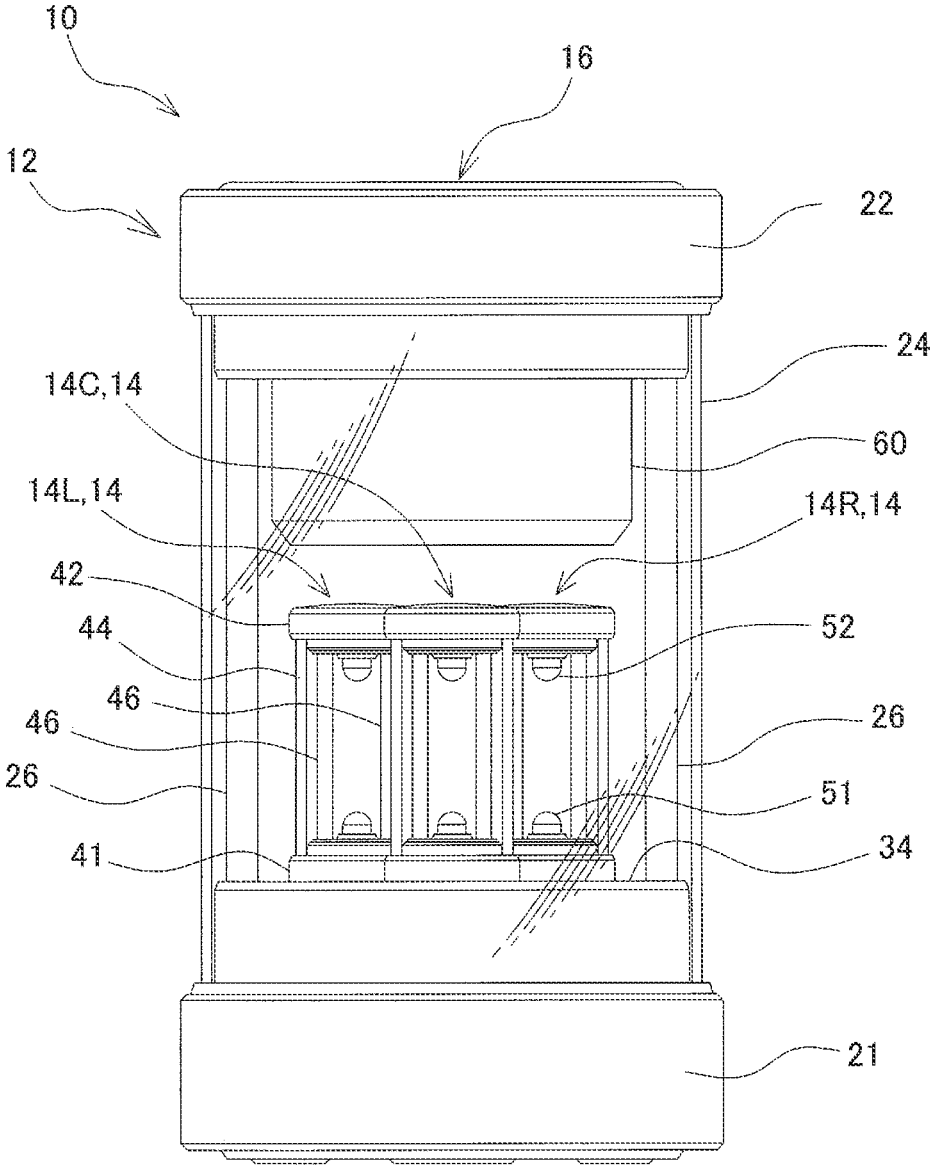
FIG. 3 is a front view of the speaker.
Figure 4:
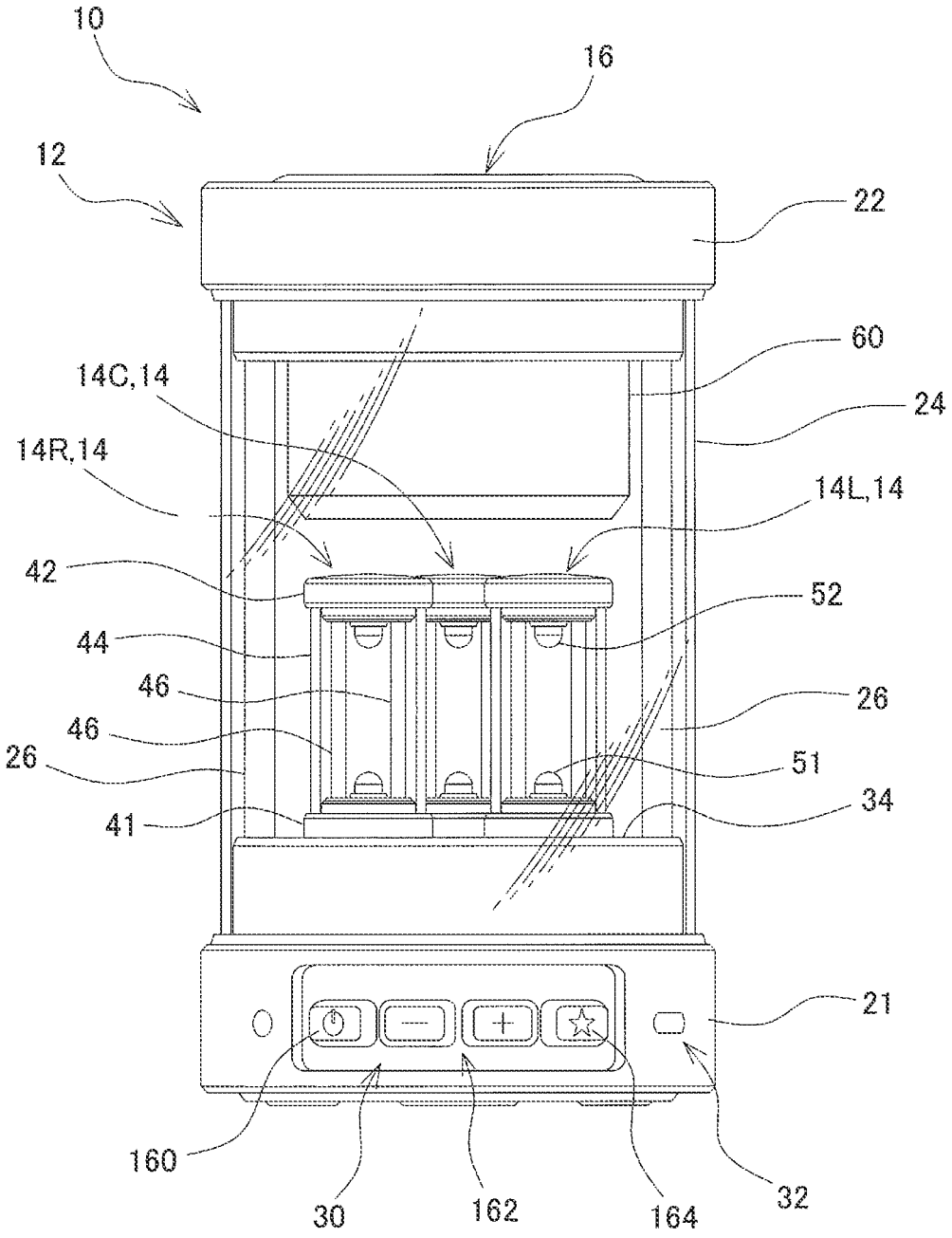
FIG. 4 is a rear view of the speaker.
Figure 5:
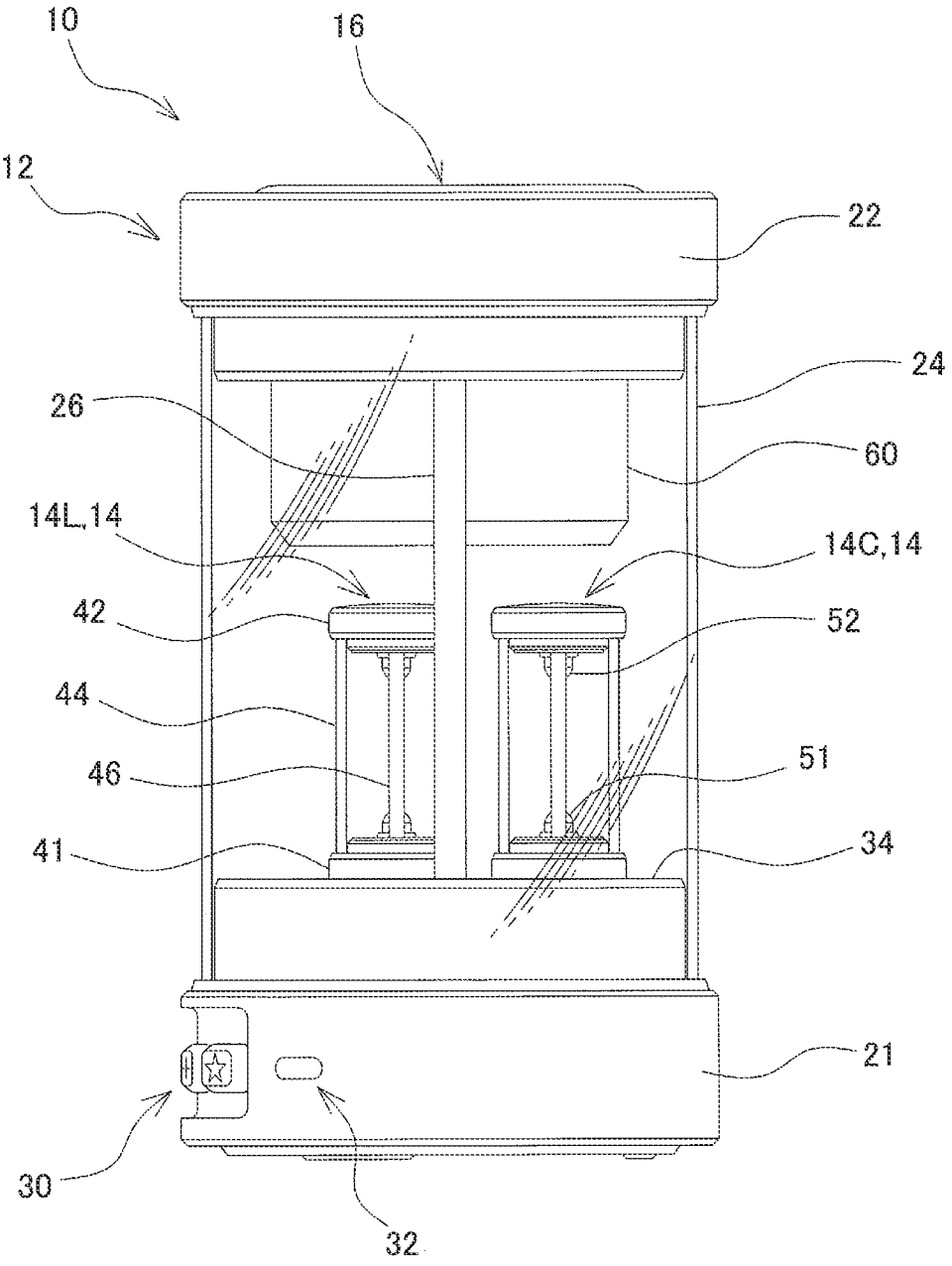
FIG. 5 is a left side view of the speaker.
Figure 6:
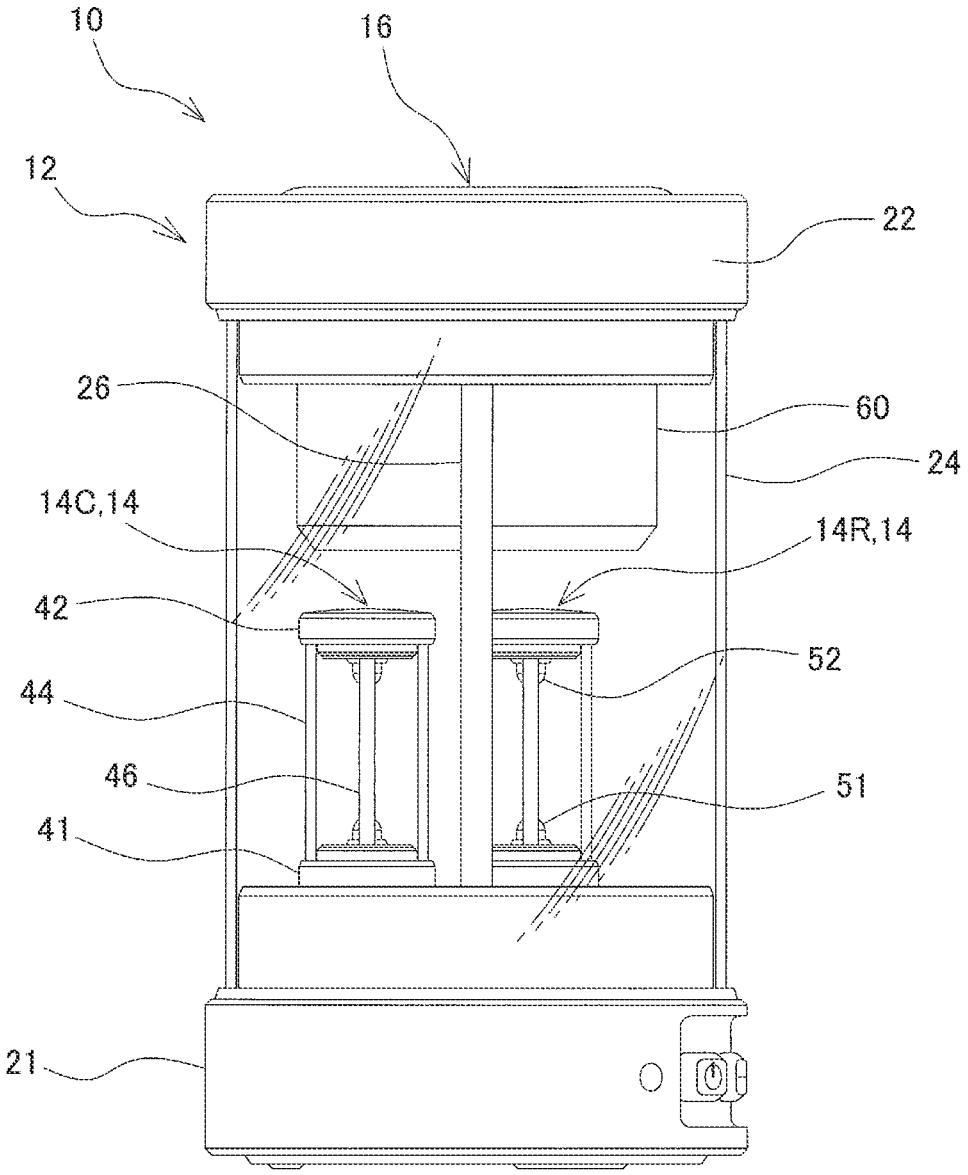
FIG. 6 is a right side view of the speaker.
Figure 7:
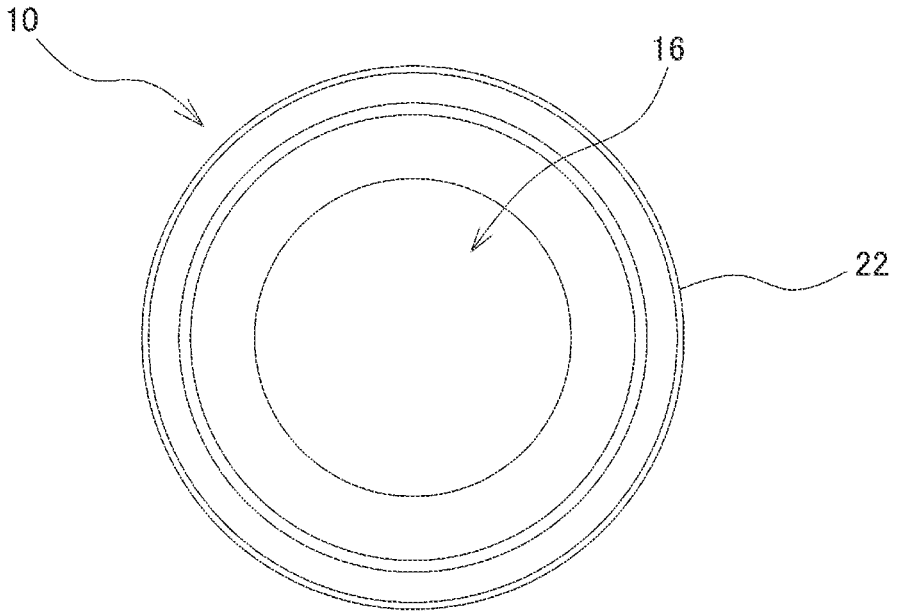
FIG. 7 is a plan view of the speaker.
Figure 8:
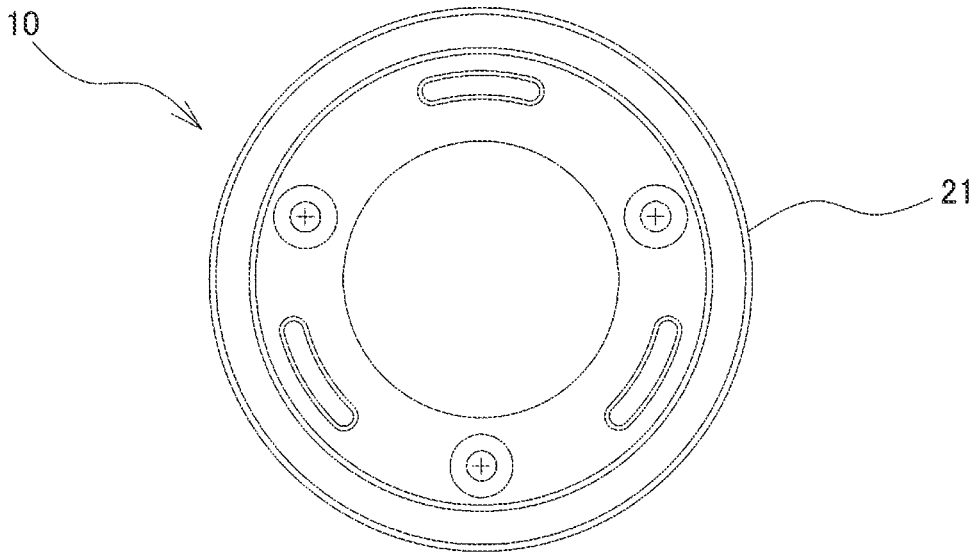
FIG. 8 is a bottom view of the speaker.

FIGS. 1 to 8 are external views of a speaker 10 according to an embodiment of the present invention. FIG. 1 is a front side perspective view, FIG. 2 is a back side perspective view, FIG. 3 is a front view, FIG. 4 is a rear view, FIG. 5 is a left side view, FIG. 6 is a right side view, FIG. 7 is a plan view, and FIG. 8 is a bottom view. The speaker 10 is a device that wirelessly receives music signals, audio signals (hereinafter, also referred to as sound signals) from terminals such as smartphones, tablets, and personal computers (PCs), and generates sound from a speaker portion 16 based on the sound signals, and emits light in conjunction with sound.

The speaker 10 is a closed type speaker and is a so-called monaural speaker having only one speaker portion. However, as described below, the speaker 10 independently drives two LED elements according to left and right signal components of the sound signal, so as to have a function of enabling users to visually enjoy a stereo feeling.

The speaker 10 has a substantially columnar shape, and includes a main unit 12 and three LED units 14C, 14L, and 14R arranged in the main unit 12. The main unit 12 reminds users of a stage, a theater, a live music club, or the like where performers appear, for example. The three LED units 14C, 14L, and 14R remind users of, for example, three performers standing on the stage.

Figure 12:
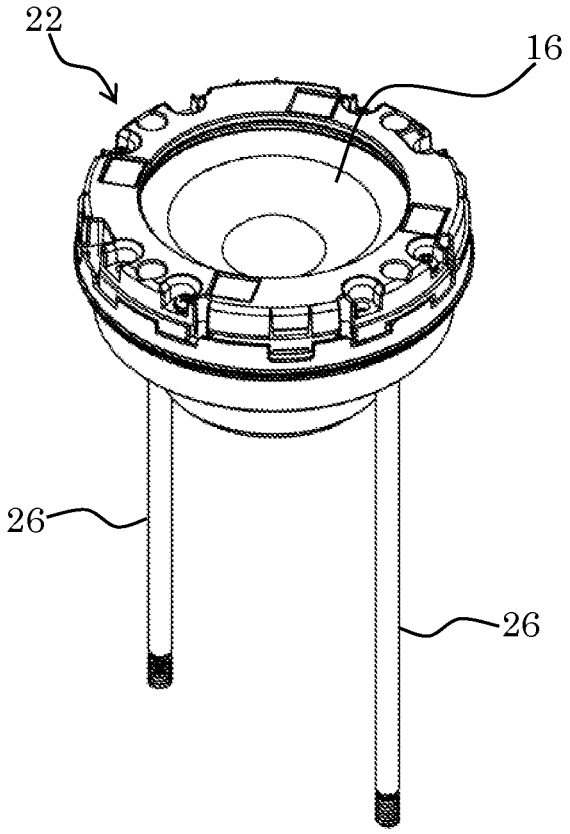
FIG. 12 is a perspective view illustrating a part of the first head portion.

The main unit 12 includes a first base portion 21 (also referred to as a base assembly) that includes a battery, a control unit, and the like provided therein, a first head portion 22 (also referred to as a head assembly) that is arranged on the upper side of the first base portion 21 and includes the speaker portion 16 directed upward, and a first housing 24 arranged between the first base portion 21 and the first head portion 22. In FIGS. 1, 2, and 7, a net-like member arranged on the speaker portion 16 is illustrated in a state where net holes are omitted. The speaker portion 16 is arranged under the net-like member, so that the sound outputs in an upward direction as illustrated in FIG. 12. The speaker portion 16 has a configuration including a speaker driver that drives a cone. As illustrated in FIGS. 1 and 2, the first housing 24 is a transparent cover (clear cover) having a cylindrical shape and made of an acrylic resin with an emphasis on transmissivity.

The first base portion 21 has a substantially columnar shape, in which the radius of the cylinder at an upper part thereof is smaller so that the upper part is fit into the first housing 24 and closes a lower-side opening of the first housing 24. An upper surface of the first base portion 21 configures a stage 34, and as illustrated in FIGS. 3 and 4, the stage 34 is provided with the three LED units 14C, 14L, and 14R each extending vertically. As illustrated in FIG. 4, on a speaker back side, the first base portion 21 has a lower side surface that is provided with a button group 30 composed of a power button 160, sound switching buttons 162, and a mode switching button 164, and a connector portion 32 to which a terminal of a charger for charging the battery arranged in the first base portion 21 can be connected.

The first head portion 22 has a substantially columnar shape, in which the radius of the cylinder at a lower part thereof is smaller so that the lower part is fit into the first housing 24 and closes an upper-side opening of the first housing 24. The first head portion 22 includes a cover 60 that covers a lower-side outer periphery of the speaker portion 16.

The first base portion 21 and the first head portion 22 are connected by two pillars 26 each serving as first connection means. The pillar 26 has a pipe shape, and has an internal space in which wiring is arranged for electrically connecting the control unit in the first base portion 21 and the speaker portion 16 of the first head portion 22. The pillar 26 is made of stainless steel, and has an outer surface to which nickel plating and clear color coating have been applied to have reflectivity.

The three LED units 14C, 14L, and 14R have similar structures. Hereinafter, when it is unnecessary to distinguish among the three LED units 14C, 14L, and 14R, each of the LED units 14C, 14L, and 14R is referred to as an LED unit 14. The LED unit 14 includes a second base portion 41, a second head portion 42 arranged on the upper side of the second base portion 41, and a second housing 44 arranged between the second base portion 41 and the second head portion 42. Like the first housing 24, the second housing 44 is a transparent cover (clear cover) having a cylindrical shape and made of an acrylic resin with an emphasis on transmissivity.

The second base portion 41 has a substantially columnar shape, in which the radius of the cylinder at an upper part thereof is smaller so that the upper part is fit into the second housing 44 and closes a lower-side opening of the second housing 44. The second base portion 41 has an outer surface to which plating has been applied to have reflectivity. A lower-side LED element 51 (also referred to as a first LED element) is attached to an upper central part of the second base portion 41 so as to have an optical axis directed upward. The second base portion 41 and the first base portion 21 are provided with inside through holes (not illustrated), in which wiring is arranged so as to extend therethrough. The first LED element 51 and the control unit in the first base portion 21 are electrically connected by the wiring.

The second head portion 42 has a substantially columnar shape, in which the radius of the cylinder at a lower part thereof is smaller so that the lower part is fit into the second housing 44 and closes an upper-side opening of the second housing 44. The second head portion 42 includes an outer surface to which plating has been applied to have reflectivity. The second head portion 42 has a lower central part to which an upper-side LED element 52 (also referred to as a second LED element) is attached so as to have an optical axis directed downward. The lower-side LED element 51 and the upper-side LED element 52 are arranged to face each other.

The second base portion 41 and the second head portion 42 are connected by two pillars 46 serving as second connection means. The pillar 46 has a pipe shape, and has an internal space in which wiring is arranged for electrically connecting the upper-side LED element 52 and the control unit in the first base portion 21. This wiring is passed in the through hole provided in each of the second base portion 41 and the first base portion 21. Like the pillar 26, the pillar 46 is made of stainless steel, and has an outer surface to which nickel plating and clear color coating have been applied to have reflectivity.

The lower-side LED element 51 and the upper-side LED element 52 of each of the LED units 14C, 14L, and 14R are driven by the control unit to emit light in conjunction with the sound output from the speaker portion 16.

Figure 9:
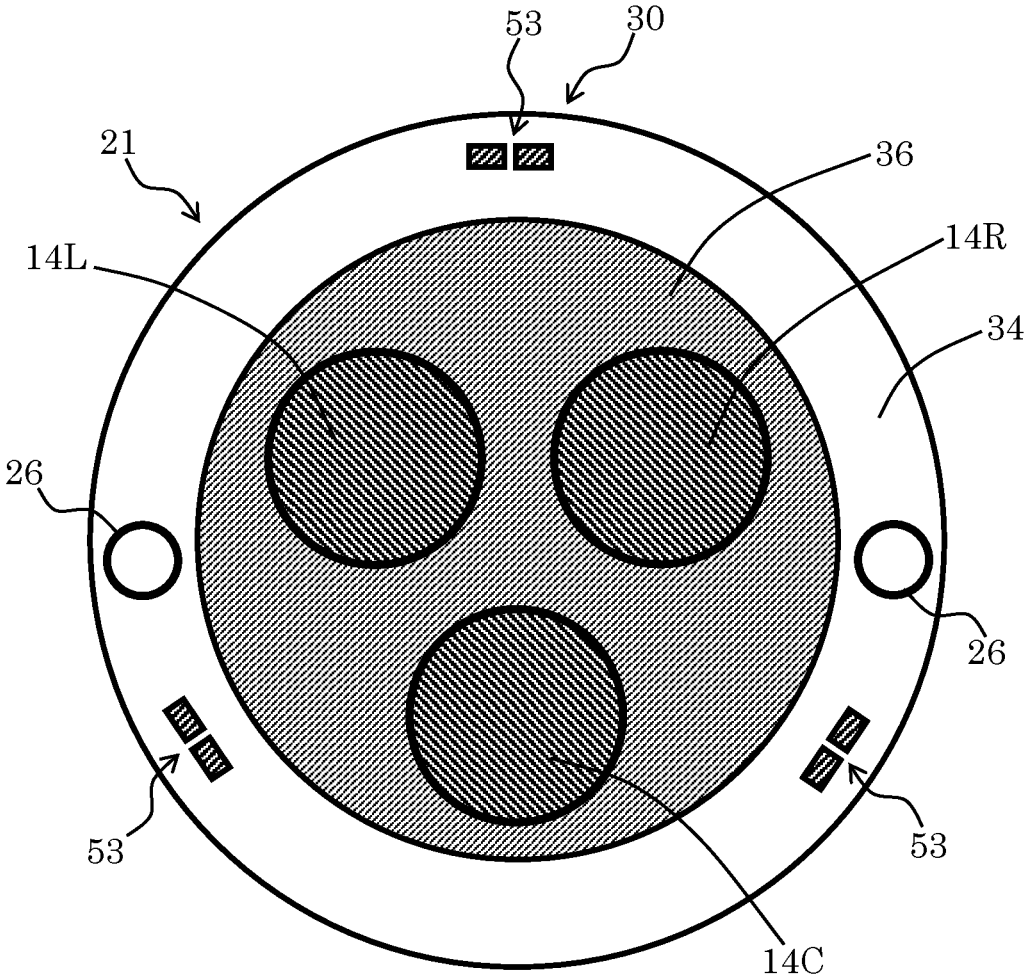
FIG. 9 is a drawing schematically illustrating an arrangement of respective members on a stage.
Figure 9:
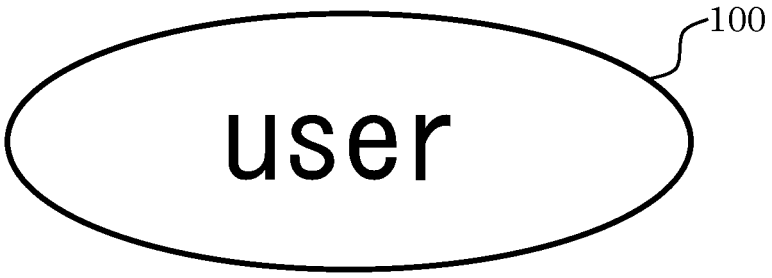

FIG. 9 is a drawing schematically illustrating the arrangement of each member on the stage 34 of the first base portion 21. The speaker 10 has a side (front side) that is viewed by a user 100 when used, as a side opposite to the side where the button group 30 is located. However, this is a typical usage form, and no limitation is imposed on the side of the speaker 10 that the user 100 views.

In the top view of the speaker 10, the LED units 14C, 14L, and 14R are arranged so that lines connecting their centers form an equilateral triangle. Further, in the front view of the speaker 10 (see FIG. 3), one LED unit 14C is arranged in the center in a speaker width direction (the left/right direction in FIG. 3), and the LED unit 14L and the LED unit 14R are arranged on respective sides of the LED unit 14C in the speaker width direction. Hereinafter, the LED unit 14C, the LED unit 14L, and the LED unit 14R are also referred to as a center LED unit 14C, a left-side LED unit 14L, and a right-side LED unit 14R, respectively.

As illustrated in FIGS. 1, 2, and 9, a circular reflective plate 36 is arranged on the second base portion 41 side of the three LED units 14C, 14L, and 14R, which is the center of the stage 34. The reflective plate 36 is made of ABS resin, and a mirror surface is formed by depositing aluminum on an upper surface thereof and then applying clear color coating.

As illustrated in FIG. 9, the stage 34 has an outer peripheral portion where multiple stage LED elements 53 (also referred to as third LED elements) each having an optical axis directed upward are provided. The stage LED elements 53 are attached to an upper-side outer peripheral portion of the first base portion 21. Each stage LED element 53 is composed of two LED elements as a set. Three LED element sets are respectively arranged in the circumferential direction with intervals therebetween, so that the positions of respective sets correspond to clearances between the three LED units 14C, 14L, and 14R, respectively. The stage LED elements 53 are electrically connected to the control unit in the first base portion 21 by wiring, and are driven by the control unit to emit light in conjunction with the sound output from the speaker portion 16.

Figure 10:
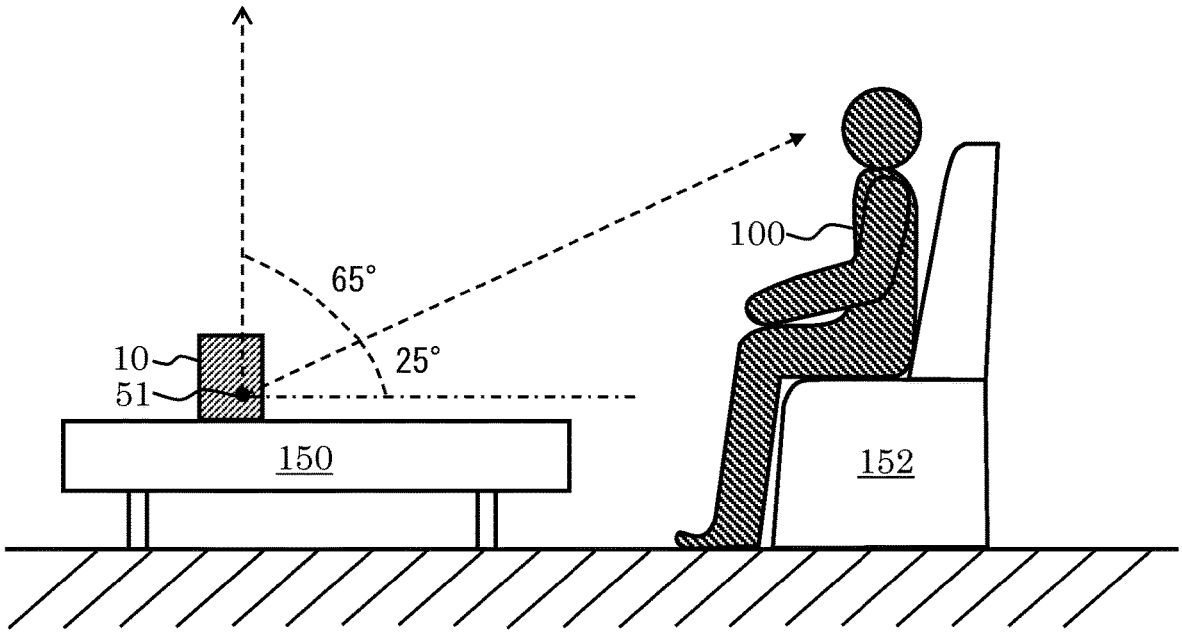
FIG. 10 is a diagram illustrating the light that reaches a user's eyes from the speaker.

Next, illumination angles of the lower-side and upper-side LED elements 51 and 52 of the LED unit 14 will be described. The lower-side and upper-side LED elements 51 and 52 are wider angle illumination elements each having a ½ beam angle of 130 degrees. FIG. 10 illustrates the ½ beam angle of the lower-side LED element 51 of the LED unit. Since the lower-side LED element 51 has the optical axis directed upward, it is possible to obtain at least half the brightness directly above the lower-side LED element 51 in a range from the direction directly above to the direction tilted by 65 degrees downward therefrom.

As illustrated in FIG. 10, when the speaker 10 is placed on a low table 150 and the user 100 sits on a sofa 152 beside the low table 150, it is assumed that the eye position of the user 100 is in a direction tilted downward by 60 to 65 degrees from the direction directly above the lower-side LED element 51. Therefore, the user 100 can obtain sufficient brightness from the lower-side LED element 51. In general, human beings do not recognize, or have difficulty in recognizing that it has become dark unless the brightness is reduced to half or less, and therefore the user can be sensitive to the brightness similar to that directly above the lower-side LED element 51.

Further, it is possible to secure the brightness of approximately 20% of the maximum luminance of the lower-side LED element 51 or the upper-side LED element even at the position just beside the lower-side LED element 51 or the upper-side LED element (in the horizontal direction or the left/right direction in FIG. 10). Therefore, it is possible to provide the user 100 with a sufficient quantity of light. In the present embodiment, the lower-side and upper-side LED elements 51 and 52 are the elements whose ½ beam angle is equal to or greater than 130 degrees, as described above. However, any elements whose ½ beam angle is equal to or greater than 120 degrees can be adopted.

Further, each of the lower-side and upper-side LED elements 51 and 52 of the LED unit 14 and the stage LED elements 53 mounted on the speaker 10 has an upward or downward optical axis. Namely, the optical axis is not oriented in the horizontal direction, and therefore it is also possible to prevent the user 100 from feeling the glare. The user 100 can enjoy a presentation of light in conjunction with the sound of the speaker 10 with the optimum brightness.

Next, a fixing structure of the speaker portion 16 of the first head portion 22 will be described. The speaker 10 of the present embodiment is configured to use the space between the first base portion 21 and the first head portion 22 as a space for the presentation of light. Therefore, users can see the space that cannot be seen from the outside when the speaker is a conventional wooden type. According to conventional speakers, no problem will arise, because screws fixing the speaker portion 16 protrude into a speaker box since such a space cannot be seen. However, in the speaker 10 of the present embodiment, the protrusion of the screws can be seen and will cause a problem. Therefore, to solve the above problem, the speaker 10 of the present embodiment adopts a characteristic structure as the fixing structure of the speaker portion 16.

Figure 11:
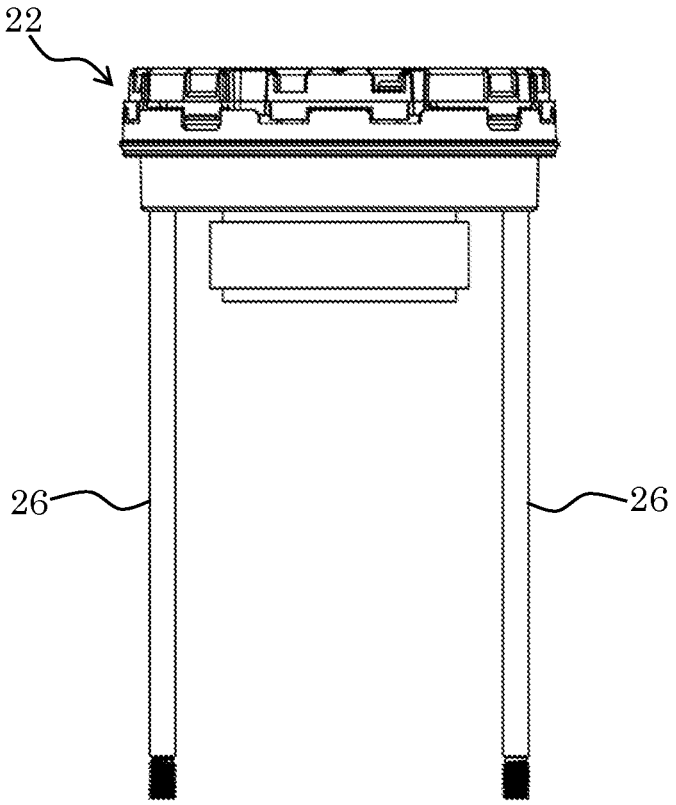
FIG. 11 is a front view illustrating a part of a first head portion.
Figure 13:
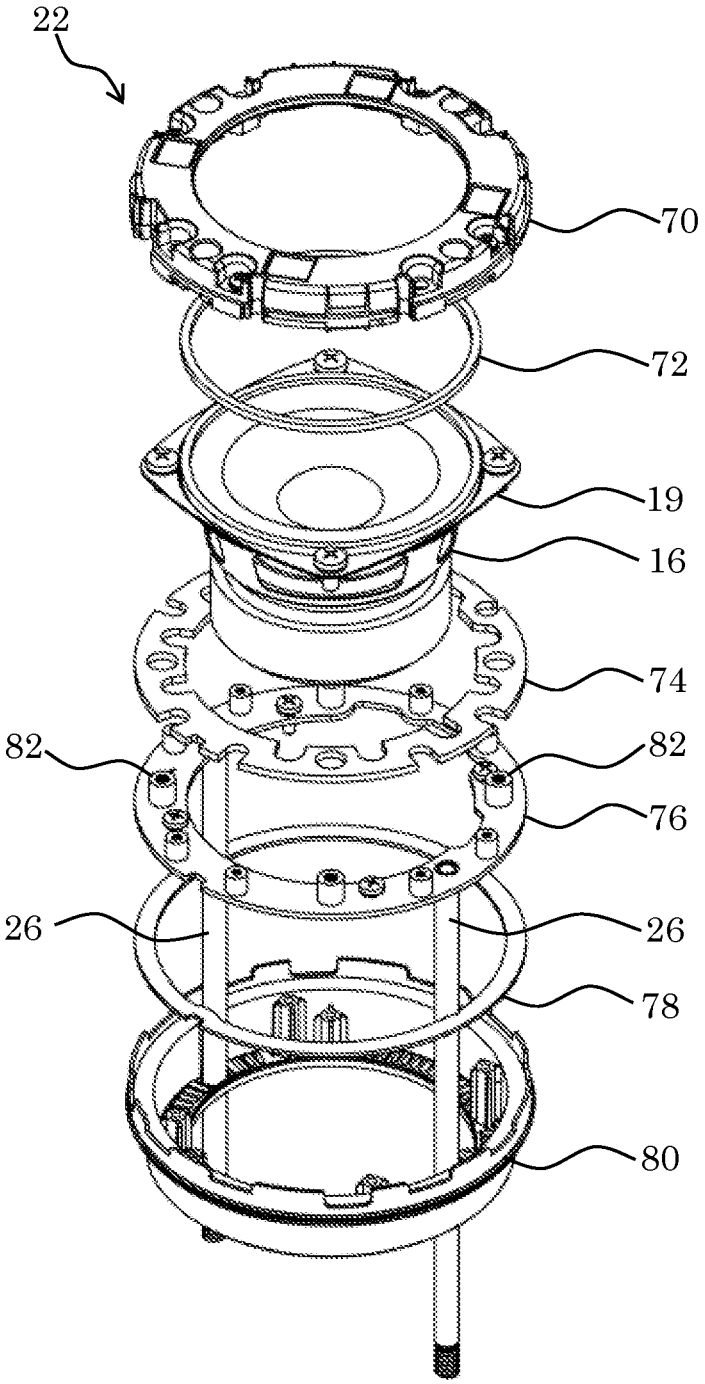
FIG. 13 is an exploded perspective view illustrating a part of the first head portion.

FIGS. 11, 12, and 13 are a front view, a perspective view, and an exploded perspective view of a part of the first head portion 22, respectively. FIGS. 11, 12, and 13 also illustrate the two pillars 26. As illustrated in FIG. 13, the first head portion 22 includes, in order from the top, a pressing plate 70 that presses the speaker portion 16 from above, an annular upper-part cushion 72, the speaker portion 16, an annular upper-side cushion frame 74 (also referred to as a cushion member), an annular frame 76, an annular lower-side cushion frame 78, and a cabinet 80. Upper ends of the two pillars 26 are attached to the frame 76.

The speaker portion 16 has a fixing part 19 whose upper-side fringe protrudes outward. The fixing part 19 of the speaker portion 16 is provided with multiple holes, and the speaker portion 16 can be fixed to the frame 76 by inserting screws into respective holes and screwing them into the frame 76.

Here, the speaker portion 16 is not directly screwed to the frame 76. Instead, the frame 76 is provided with bosses 82 so that the speaker portion 16 is screwed to the bosses 82. Multiple cylindrical bosses 82 are provided on the upper surface of the frame 76 with intervals therebetween, so that they positionally correspond to screw holes of the fixing part 19 of the speaker portion 16. The fixing part 19 of the speaker portion 16 is placed on the bosses 82 of the frame 76. Each screw of the fixing part 19 of the speaker portion 16 is screwed into the hole of the corresponding boss 82 of the frame 76. Adopting such a fixing structure enables the speaker portion 16 to be firmly fixed to the frame 76 and prevents the screws from protruding from the lower side of the first head portion 22 and being viewed by users.

The speaker 10 of the present embodiment is a closed type. Providing the bosses 82 on the frame 76 leads to formation of a space between the lower surface of the fixing part 19 of the speaker portion 16 and the upper surface of the frame 76 in a region where the bosses 82 are not provided, and therefore the airtightness cannot be maintained. To cope with this, the speaker 10 of the present embodiment includes the upper-side cushion frame 74 (cushion member) arranged on the upper surface of the frame 76 while avoiding each boss 82. The upper-side cushion frame 74 closes the space formed by the bosses 82 between the lower surface of the fixing part 19 of the speaker portion 16 and the upper surface of the frame 76. As a result, the airtightness of the speaker 10 can be ensured. Further, in the present embodiment, the lower-side cushion frame 78 is provided on the lower side of the frame 76, and the upper-part cushion 72 is provided on the upper side of the speaker portion 16. These members enhance the airtightness of the speaker 10.

Figure 14:
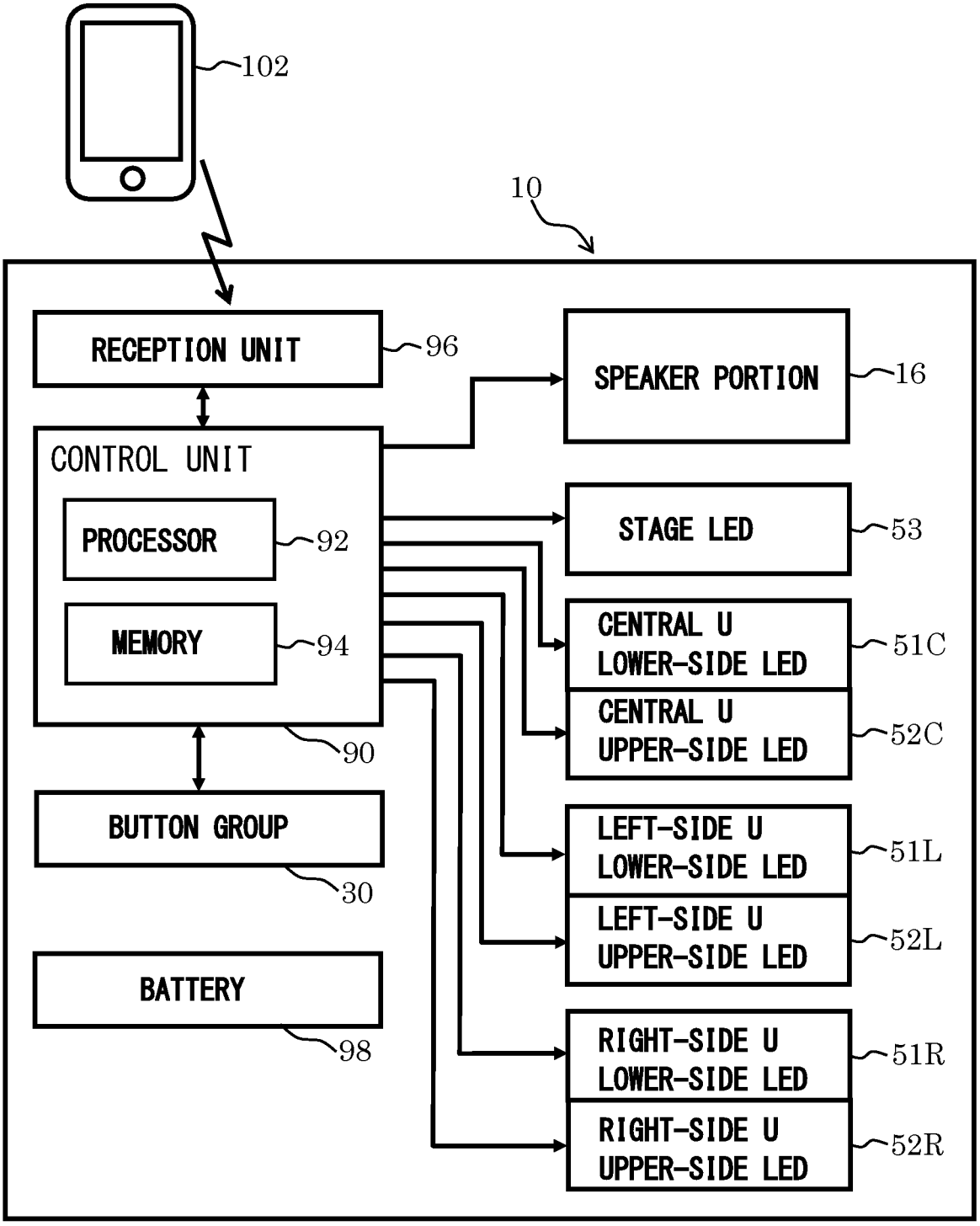
FIG. 14 is a schematic block diagram illustrating an electric system of the speaker.

Next, an electric system of the speaker 10 will be described. FIG. 14 is a schematic block diagram illustrating the electric system of the speaker 10. The speaker 10 includes a control unit 90, a reception unit 96, and a battery 98. These components are arranged inside the first base portion 21.

The control unit 90 includes a processor 92 and a memory 94. The processor 92 operates according to a program stored in the memory 94 and controls the speaker portion 16, the lower-side and upper-side LED elements 51 and 52 of each LED unit 14, and the stage LED elements 53. The memory 94 is, for example, a memory (RAM, ROM, flash memory, or the like) made of a semiconductor element and stores the program and various data.

The reception unit 96 sequentially receives sound signals from a terminal 102, such as a smartphone, and transmits the received signals to the control unit 90. The terminal 102 transmits the sound signals to the reception unit 96 of the speaker 10 by using wireless communication complying with Bluetooth (registered trademark) or similar standards.

The battery 98 supplies electric power to each part of the speaker 10 that requires power supply. The battery 98 is a secondary battery that is charged when the charger terminal is connected to the connector portion 32 (see FIGS. 2 and 4) provided on the side surface of the first base portion 21 and electric power is supplied.

Operation information of each button of the button group 30 provided on the side surface of the first base portion 21 is input to the control unit 90. The button group 30 includes, as illustrated in FIG. 4, the power button 160 with a power mark attached thereto, two sound volume switching buttons 162 with "+" and "–" marks attached thereto, and the mode switching button 164 with a star mark attached thereto. The control unit 90 controls whether to supply electric power from the battery 98 to each part of the speaker 10 according to the operation information of the power button 160. Further, the control unit 90 controls the sound volume of the speaker portion 16 according to the operation information of the sound volume switching buttons 162. In addition, the control unit 90 controls a light presentation mode (described below) of the LED element according to the operation information of the mode switching button 164.

The control unit 90 includes a power amplifier (not illustrated). The processor 92 of the control unit 90 drives the speaker portion 16, via the power amplifier, based on sound signals sequentially transmitted from the reception unit 96. Further, the control unit 90 includes LED drivers (not illustrated). The processor 92 of the control unit 90 drives respective LED elements, via the LED drivers, based on the sound signals.

Figure 15:
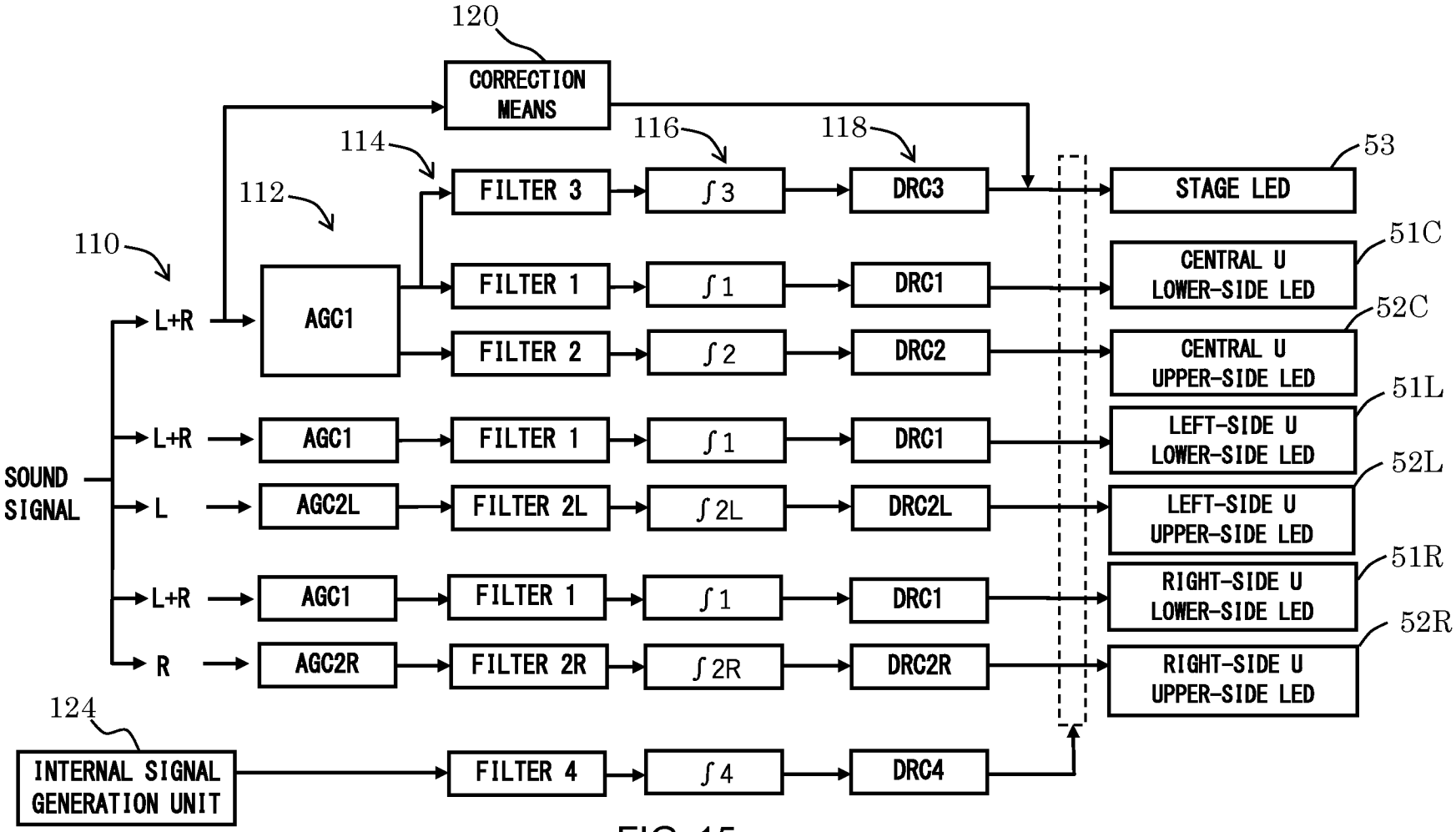
FIG. 15 is a view illustrating processing of a control unit in a first mode.
Figure 16:
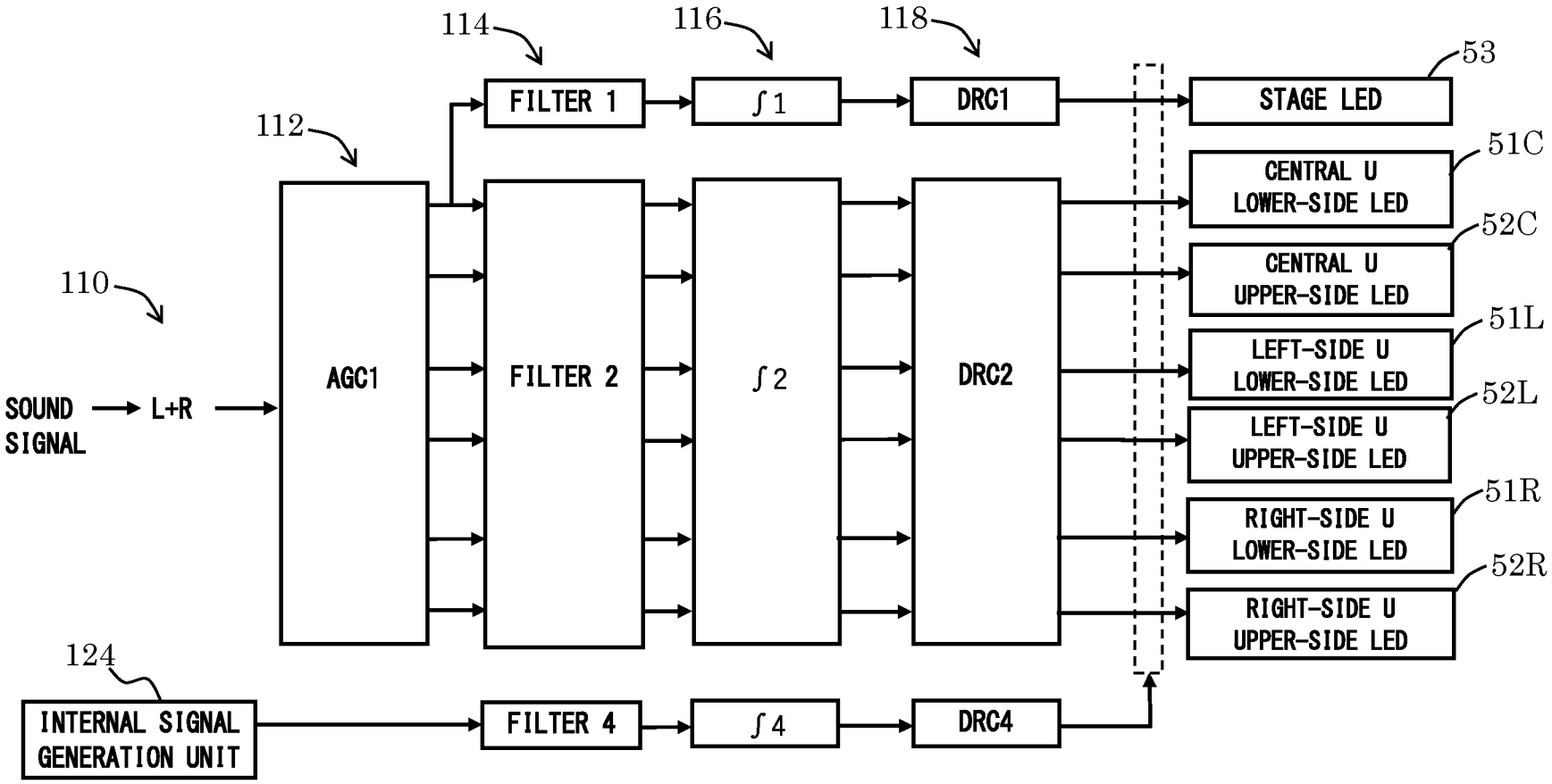
FIG. 16 is a view illustrating processing of the control unit in a second mode.

Next, the control of each LED element by the control unit 90 will be described in detail. The speaker 10 has multiple modes for changing the lighting of each LED element even if the sound signal is the same. This is referred to as the light presentation mode. In the present embodiment, first and second modes are provided. According to specifications, switching between the first mode and the second mode occurs each time the mode switching button 164 is pressed. FIG. 15 is a drawing schematically illustrating processing to be performed by the control unit 90 in the first mode, and FIG. 16 is a drawing schematically illustrating processing to be performed by the control unit 90 in the second mode. First, the first mode will be described with reference to FIG. 15.

As illustrated in FIG. 15, when operating according to the program, the processor 92 of the control unit 90 functions as a signal component extraction unit 110, an automatic gain control unit 112 (hereinafter, referred to as an AGC unit 112), a filter 114, integration means 116, and a dynamic range control unit 118 (hereinafter, referred to as a DRC unit 118). Further, the processor 92 functions as an internal signal generation unit 124 (signal generation means) that generates a driving signal for driving each LED element when no sound signal is supplied from the terminal 102. In FIG. 15, each of the AGC unit 112, the filter 114, the integration means 116, and the DRC units 118 is illustrated as a set of constituent components corresponding to the signals to be supplied to respective LED elements.

First, the sound signal is input to the signal component extraction unit 110, and a left signal component (L signal component), a right signal component (R signal component), and a mixed signal component (L+R signal component) of the left signal component and the right signal component are extracted from the sound signal.

Each of the L signal component, the R signal component, and the L+R signal component is input to the AGC unit 112, and a signal (automatic gain controlled signal) in which the gain of each signal component is adjusted is generated and output from the AGC unit 112.

Then, each output signal of the AGC unit 112 is input to the filter 114 to limit the band. Specifically, regarding the gain-adjusted L+R signal component, a low region (first frequency domain) component is extracted by a filter 1 (a low-pass filter whose cutoff frequency is set to somewhere within a range of 100 to 200 Hz, for example), and a middle-and-high region (second frequency domain) component is extracted by a filter 2 (a high-pass filter whose cutoff frequency is set to somewhere within a range of 200 to 400 Hz, for example). Further, regarding the gain-adjusted L+R signal component, a beat sound component corresponding to, for example, a percussion instrument (e.g., a bass drum) is extracted by a filter 3 (a low-pass filter whose cutoff frequency is set to 100 Hz or less, for example) that extracts a frequency band (third frequency domain) component, which is lower than that of the filter 1. Regarding the gain-adjusted L and R signal components, their middle-and-high region (second frequency domain) components are extracted by filters 2L and 2R (high-pass filters whose cutoff frequency is set to somewhere within a range of 200 to 400 Hz, for example), respectively.

The integration means 116 integrates the signal components filtered by respective filters, and the DRC unit 118 adjusts the dynamic range. As a result, a basic signal for the driving signal of each LED element is generated. Each basic signal is input to the LED driver corresponding to each LED element and converted into the driving signal, which is then supplied to each LED element.

In the present embodiment, the driving signal (first driving signal) generated from the low region (first frequency domain) component of the L+R signal component having passed through the filter 1 is supplied to lower-side LED elements 51C, 51L, and 51R of respective LED units. As a result, the lower-side LED elements 51C, 51L, and 51R of respective LED units become able to emit light in conjunction with low tones (bass sound, drum sound, and the like) of the music played on the speaker portion 16.

Further, the driving signal (second driving signal) generated from the middle-and-high region (second frequency domain) component of the L+R signal component having passed through the filter 2 is supplied to an upper-side LED element 52C of the center-side LED unit, and the driving signal (second driving signal) generated from the middle-and-high region (second frequency domain) component of the L signal component having passed through the filter 2L is supplied to an upper-side LED element 52L of the left-side LED unit. In addition, the driving signal (second driving signal) generated from the middle-and-high region (second frequency domain) component of the R signal component having passed through the filter 2R is supplied to an upper-side LED element 52R of the right-side LED unit. As a result, the upper-side LED elements 52C, 52L, and 52R of respective LED units become able to emit light in conjunction with middle and high tones (vocal voice, guitar sound, and the like) of the music played on the speaker portion 16. Further, the upper-side LED element 52L of the left-side LED unit and the upper-side LED element 52R of the right-side LED unit become able to emit light corresponding to the L signal component and the R signal component, respectively, so that a stereo feeling can be expressed visually. In this case, a predetermined ratio of R signal component may be added to the L signal component, and a predetermined ratio of L signal component may be added to the R signal component, so that the upper-side LED elements 52L and 52R can be prevented from being turned off.

Further, the driving signal (third driving signal) generated from the low region (third frequency domain) component of the L+R signal component having passed through the filter 3 is supplied to the stage LED elements 53. As a result, the stage LED elements 53 become able to emit light in conjunction with further lower tones (drum sound, and the like) of the music played on the speaker portion 16.

As described above, various driving signals generated by combining different sound signal components (L signal component, R signal component, and L+R signal component) and different frequency components are supplied to respective LED elements sterically arranged in the up-and-down, right-and-left, and back-and-forth directions. Therefore, complex light emission (presentation of light) in conjunction with the sound can be realized.

Further, in the present embodiment, when operating according to the program, the processor 92 functions as correction means for correcting the driving signal of the LED element based on the L+R signal component before the gain is adjusted by the AGC unit 112. The correction means identifies a so-called chorus portion (getting-excited portion) of the music based on not only the transition of the L+R signal component but also the current L+R signal component, and corrects the driving signal (third driving signal) of the stage LED elements 53 so that the light quantity of the stage LED elements 53 increases by a predetermined amount at the chorus portion. As a result, at the getting-excited portion of the music, the user's uplifting feeling can be further enhanced with the presentation of light in conjunction with the music.

Further, in the present embodiment, the internal signal generation unit 124 is configured to cause a predetermined number of LED elements to emit light even when no sound signal is supplied from the terminal 102 such as a smartphone (when the speaker portion 16 generates no sound). For example, when no sound signal is input, all the LED elements may emit light, or only the stage LED elements 53 may emit light.

The internal signal generation unit 124 generates a signal based on white noise. A filter 4 weakens high-frequency components of this signal. Then, after being processed by the integration means 116 and the DRC unit 118, the signal is used as the driving signal of the LED element. When this driving signal is supplied to the LED element, so-called 1/f fluctuation is realized (the LED element emits light that fluctuates). Adding such a light emission control can realize a non-boring presentation of light even when no sound signal is input. In the present embodiment, the processor 92 adjusts the driving signal of each LED element in such a way as to gradually dim (fade out) the light of each LED element when the music played on the speaker portion 16 ends, and then causes the internal signal generation unit 124 to gradually brighten (fade in) the light of each LED element.

In the above description, the L and R signal components are supplied to the upper-side LED element 52L of the left-side LED unit and the upper-side LED element 52R of the right-side LED unit, respectively, but it may be configured in such a way as to supply the L+R signal component to these LED elements 52L and 52R.

Next, the second mode will be described with reference to FIG. 16. In the second mode, only the L+R signal component is extracted from the sound signal in the signal component extraction unit 110. The L+R signal component is input to the AGC unit 112 to adjust the gain. The filter 1 (low-pass filter) extracts a low region (first frequency domain) component of the gain-adjusted L+R signal, while the filter 2 (high-pass filter) extracts a middle-and-high region (second frequency domain) component thereof. The low region component of the L+R signal component having passed through the filter 1 becomes the basic signal for the driving signal of each stage LED element 53, after passing through the integration means 116 and the DRC unit 118. The middle-and-high region component of the L+R signal component having passed through the filter 2 becomes the basic signal for the driving signal of each of the lower-side LED elements 51C, 51L, and 51R and the upper-side LED elements 52C, 52L, and 52R of each LED unit, after passing through the integration means 116 and the DRC unit 118. Each basic signal is input to the LED driver corresponding to each LED element and converted into the driving signal, which is then supplied to each LED element. The driving of the LED element using the internal signal generation unit 124 at the time of no sound generation is the same as that in the first mode.

As described above, the driving signal of each LED element is switched according to the operation of the user who uses the mode switching button 164. Having multiple modes enables provision of a presentation of light reflecting the user's preference.

Next, effects of the above-described speaker 10 of the present embodiment will be described.

According to the speaker 10 of the present embodiment, the main unit 12 including the first base portion 21, the first head portion 22, and the first housing 24 and each LED unit 14 including the second base portion 41, the second head portion 42, and the second housing 44 are similar in shape. Therefore, the speaker 10 can have excellent aesthetic properties with a sense of unity. The light emitted from the lower-side and upper-side LED elements 51 and 52 of each LED unit 14 based on the music signal reaches the eyes of the user 100 together with the speaker design possessing a feeling of transparency and a sense of unity, in a state where the light is slightly and diffusely reflected by the first and second housings 24 and 44. Accordingly, the user 100 can feel comfortable.

Further, according to the speaker 10 of the present embodiment, each LED unit 14 (object) having the transparent second housing 44 is provided in the transparent first housing 24 of the main unit 12. Therefore, there are very few obstacles that shield the light emitted from the lower-side and upper-side LED elements 51 and 52 of each LED unit 14 and the stage LED elements 53. The light can be efficiently used. The optical axis of each LED element is directed upward or downward, and is not directed toward the user (horizontal direction). However, as described above, since the lower-side and upper-side LED elements 51 and 52 of each LED unit 14 have wider illumination angles, the user can feel sufficient brightness. Further, the pillars 26 and 46 have reflective outer surfaces. The second base portion 41 and the second head portion 42 of each LED unit 14 also have reflective outer surfaces. The stage 34 has a mirror surface. Therefore, a large amount of reflective light can be obtained, and the optimum brightness can be ensured.

The speaker 10 of the present embodiment provides a completely new form of entertainment. For example, the main unit 12 reminds users of a stage, a theater, a live music club, or the like where performers appear, and each LED unit 14 is reminiscent of the performer itself. In this respect, the main unit 12 can be referred to as a stage unit or a theater unit and the LED unit 14 can be referred to as a performer unit. Three performer units 14 stand up on the first base portion 21 as if there were three performers on the stage.

The speaker 10 shows various expressions depending on the environment in which the speaker 10 is placed, the music played on the speaker 10, and the like. For example, the speaker 10 is placed in a slightly dark room. When a user listens to rock or pop music, the fluctuating light of the LED element preceding the play of the music (at the time of no input), which is realized by the internal signal generation unit 124, enhances the uplifting feeling for the music live that is about to begin. When the music is played, the stage LED elements 53 illuminate the performer units 14 with strong light to cause the three performer units 14 to appear in front of the user, and therefore the user is immediately enveloped in the excitement of the live performance.

The stage LED elements 53 emit light in such a way so as to interlock with the sound of, for example, a percussion instrument, and the profile (the second housing 44) of the performer unit 14 is illuminated. The lower-side LED element 51 of the performer unit 14 emits light interlocking with the sound of a bass guitar or a bass drum, for example, as if the performer was taking a beat with his/her foot. The upper-side LED element 52 of the performer unit 14 emits light in such a way as to interlock with a guitar sound or a voice, for example. In the first mode, the left and right performer units 14L and 14R emit light as if they were playing differently, for example. This makes it possible to visually recognize the presentation as if there were different performers on the left and right sides. When the correction means 120 causes the stage LED elements 53 to emit stronger light at the getting-excited portion of the music, the user is enveloped in a comfortable feeling of lively motion due to the strong light that is visually recognized along with the music.

The speaker 10 of the present embodiment provides a new form of entertainment in which the music can be visually recognized. This is completely different from a video such as a music video. It is feasible to freely imagine the three performers standing on the stage 34 of the first base portion 21, as if the user was reading a book while freely imagining a scene or a person appearing therein. No extra information is in the user's eyes, and the user will be filled with comfort by the music and the light interlocking with it. The speaker 10 with a feeling of transparency and a sense of unity, when combined with the light appearing there and interlocking with the music, will not make the user bored.

When the music ends, the light that fades out quietly will calm down the user's uplifting feeling, leaving a lingering sound and emotional impression of the light. Then, by the internal signal generation unit 124, the fluctuating light of the LED element fades in. This gives the user the expectation of waiting for the next live performance to begin.

The user cannot easily predict how the speaker 10 will shine. When playing new music, the user looks forward to viewing how it shines and can feel the expectation and excitement.

The speaker 10 of the above embodiment is a mere example of the speaker of the present invention, and it should be noted that the speaker of the present invention is not limited to the above example. The members configuring the speaker 10 of the above embodiment, even when some of them are removed or added, or even when they are changed in position, changed in form (shape, pattern, color, and the like), or changed in operation, are within the scope of the speaker of the present invention so long as the gist of the present invention is not changed.

For example, the following forms are also within the scope of the speaker of the present invention. However, described below are mere examples. Each of the main unit 12 and the LED unit 14 may have a prismatic shape (a triangular prismatic shape, a square prismatic shape, or the like) or another shape similar thereto. The pillars 26 and 46 of the main unit 12 and the LED unit 14 may be provided in the center of each unit. The first and second housings 24 and 44 may have a partial shielding property. An LED element (referred to as a head LED element) having an optical axis directed downward may be provided on the first head portion 22 to illuminate the inside of the first housing 24 from above. The stage LED elements 53 may be arranged at the center of the stage 34. The number of the LED units 14 may be one, two, or not less than four, and the number of the LED elements in the LED unit 14 may be one or not less than three. One or all LED elements of one or plural LED units 14 may emit light based on the left signal component, the right signal component, or the mixed signal component of the sound signal. At least one head LED element or stage LED element 53 may emit light based on the left signal component, the right signal component, or the mixed signal component of the sound signal. One or plural LED elements may be provided so as to have a horizontal, or diagonally upward or downward, optical axis. Multiple speaker portions 16 may be provided. Some or all of the multiple speaker portions 16 may be used to output a stereo sound. One, two or more, or all of the speaker portions 16 may be arranged sideways so that sound is output in the horizontal direction. It should be noted that the characteristic portions described above may be appropriately combined and configured.

In the above-described embodiment, the processor is any processor in a broad sense and may be a general-purpose processor (e.g., a central processing unit (CPU)), or a dedicated processor (e.g., an application specific integrated circuit (ASIC), a field programmable gate array (FPGA), or a programmable logic device). The operation of the processor is not limited to that performed by a single processor, but may be performed by multiple processors located at physically separated portions in cooperation with each other.

REFERENCE SIGNS LIST

10 speaker, 12 main unit (stage unit), 14, 14C, 14L, 14R LED unit (performer unit), 16 speaker portion, 19 fixing part, 21 first base portion (base assembly), 22 first head portion (head assembly), 24 first housing, 26 pillar (first connection means), 30 button group, 32 connector portion, 34 stage, 36 reflective plate, 41 second base portion, 42 second head portion, 44 second housing, 46 pillar (second connection means), 51, 51C, 51L, 51R lower-side LED element (first LED element), 52, 52C, 52L, 52R upper-side LED element (second LED element), 53 stage LED element (third LED element), 60 cover, 70 pressing plate, 72 upper-part cushion, 74 upper-side cushion frame (cushion member), 76 frame, 78 lower-side cushion frame, 80 cabinet, 82 boss, 90 control unit, 92 processor, 94 memory, 96 reception unit, 98 battery, 100 user, 102 terminal, 110 signal component extraction unit, 112 AGC (automatic gain control), 114 filter, 116 integration means, 118 DRC (dynamic range control), 120 correction means, 124 internal signal generation unit, 150 low table, 152 chair, 160 power button, 162 sound volume switching button, 164 mode switching button.

The invention claimed is:

1. A speaker that outputs sound from a speaker portion arranged upward, comprising:

a first head portion including the speaker portion;

a first base portion;

a first housing having transmissivity and arranged between the first head portion and the first base portion;

at least one LED unit arranged in the first housing; and a control unit configured to drive LED elements of the LED unit based on a sound signal from the outside, wherein the LED unit includes a second head portion, a second base portion, and a second housing having transmissivity and arranged between the second head portion and the second base portion.

2. The speaker according to claim 1, wherein the first head portion is arranged on the upper side of the first base portion with an interval therebetween, and an upper-side surface of the first base portion includes a mirror surface.

3. The speaker according to claim 1, further comprising:

first connection means having a reflective outer surface, wherein the first head portion and the first base portion are connected by the first connection means.

4. The speaker according to claim 1, wherein the LED unit further includes second connection means having a reflective outer surface, and the second head portion and the second base portion are connected by the second connection means.

5. The speaker according to claim 1, wherein a first LED element serving as one of the LED elements is attached to the second base portion, and a second LED element serving as another one of the LED elements is attached to the second head portion.

6. The speaker according to claim 5, wherein the second head portion is arranged on the upper side of the second base portion with an interval therebetween, and the first LED element is attached to the second base portion so as to have an optical axis directed upward, and the second LED element is attached to the second head portion so as to have an optical axis directed downward.

7. The speaker according to claim 5, wherein the control unit:

supplies, to the first LED element, a first driving signal based on a signal whose main component is a first frequency domain of the sound signal, and supplies, to the second LED element, a second driving signal based on a signal whose main component is a second frequency domain of the sound signal, in which the second frequency domain is higher than the first frequency domain.

8. The speaker according to claim 7, wherein the control unit switches the driving signal supplied to the first LED element from the first driving signal to the second driving signal, according to a user operation.

9. The speaker according to claim 7, wherein a third LED element is attached to an upper-side outer peripheral portion of the first base portion, so as to have an optical axis directed upward, and the control unit supplies, to the third LED element, a third driving signal based on a signal whose main component is a third frequency domain of the sound signal, in which the third frequency domain is lower than the first frequency domain.

10. The speaker according to claim 9, wherein the control unit corrects the third driving signal based on the transition of the sound signal and the current sound signal.

11. The speaker according to claim 1, further comprising signal generation means, wherein, when no sound signal is supplied from the outside, the control unit drives the LED element based on a signal generated by the signal generation means, instead of based on the sound signal.

12. The speaker according to claim 1, wherein when the speaker is viewed from the front, a center LED unit is arranged in a center and a left-side LED unit and a right-side LED unit are arranged on left and right sides of the center LED unit, as multiple LED units, and the control unit:

supplies a driving signal based on a left signal component of the sound signal to an LED element of the left-side LED unit, supplies a driving signal based on a right signal component of the sound signal to an LED element of the right-side LED unit, and supplies a driving signal based on a mixed signal component of the left signal component and the right signal component to an LED element of the center LED unit.

13. The speaker according to claim 3, wherein the first head portion includes a frame, to which an upper end of the first connection means is attached, and a cushion member, multiple bosses are provided on an upper surface of the frame with intervals therebetween, the cushion member is arranged on the upper surface of the frame, while avoiding each of the bosses, a fixing part provided on an outer periphery of the speaker portion is arranged on each boss of the frame and fixed, and a space formed by each boss between a lower surface of the fixing part of the speaker portion and the upper surface of the frame is closed by the cushion member.

14. The speaker according to claim 1, wherein the LED element of the LED unit has a ½ beam angle that is equal to or greater than 120 degrees.

15. The speaker according to claim 2, further comprising:

first connection means having a reflective outer surface, and the first head portion and the first base portion are connected by the first connection means.

16. The speaker according to claim 15, wherein the LED unit further includes second connection means having a reflective outer surface, and the second head portion and the second base portion are connected by the second connection means.

17. The speaker according to claim 15, wherein a first LED element serving as one of the LED elements is attached to the second base portion, and a second LED element serving as another one of the LED elements is attached to the second head portion.

18. The speaker according to claim 8, wherein a third LED element is attached to an upper-side outer peripheral portion of the first base portion, so as to have an optical axis directed upward, and the control unit supplies, to the third LED element, a third driving signal based on a signal whose main component is a third frequency domain of the sound signal, in which the third frequency domain is lower than the first frequency domain.

* * * * *